United States Patent [19]

Akerley et al.

[11] Patent Number: 5,020,660

[45] Date of Patent: Jun. 4, 1991

[54] DISPLAY HANGER PACKAGE FOR ROLL

[75] Inventors: Arnold J. Akerley, Westborough, Mass.; W. Paul Manning, Jr., Bowling Green, Ky.

[73] Assignee: The Kendall Company, Lexington, Mass.

[21] Appl. No.: 498,653

[22] Filed: Mar. 26, 1990

[51] Int. Cl.[5] ..... B65D 85/671

[52] U.S. Cl. ..... 206/45.14; 206/396; 206/397; 206/411; 206/492

[58] Field of Search ..... 206/45.14, 395, 396, 206/397, 403, 405, 406, 408, 411, 492, 493

[56] References Cited

U.S. PATENT DOCUMENTS

| | | | |
|---|---|---|---|
| 2,617,577 | 11/1952 | Tardiff | 206/45.14 X |
| 2,973,858 | 3/1961 | Laneve et al. | 206/396 |
| 3,401,792 | 9/1968 | Tolaas | 206/396 X |
| 3,402,501 | 9/1968 | Davis | 206/395 X |
| 3,964,606 | 6/1976 | Hogg et al. | 206/395 |
| 4,042,168 | 8/1977 | Kasel et al. | 206/396 X |
| 4,049,120 | 9/1977 | Bower | 206/396 |
| 4,140,218 | 2/1979 | Forté | 206/395 X |
| 4,239,110 | 12/1980 | Enke et al. | 206/396 |
| 4,496,049 | 1/1985 | Pabodie et al. | 206/395 |
| 4,561,542 | 12/1985 | Przepiora et al. | 206/45.14 X |
| 4,700,835 | 10/1987 | Rognsvoog, Jr. | 206/411 |

*Primary Examiner*—Paul T. Sewell
*Assistant Examiner*—Jacob K. Ackun, Jr.
*Attorney, Agent, or Firm*—M. Maus

[57] ABSTRACT

A blank for a roll of tape is disclosed which is constructed from a blank having a fold line so that it may be folded over and glued. Each side of the blank on either side of the fold line has a U-shaped aperture extending in the same direction. The two U-shaped apertures are positioned and dimensioned whereby they are in registry. The roll of tape is mounted on the folded blank in a manner that the portions between the U-shaped apertures are inserted each from opposite sides of the blank as it is folded whereby the portions are axially located with respect to the roll of tape.

5 Claims, 1 Drawing Sheet

Fig. 1
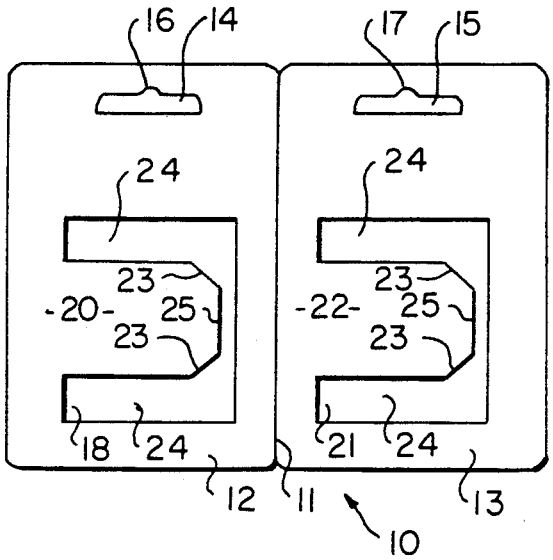
Fig. 3
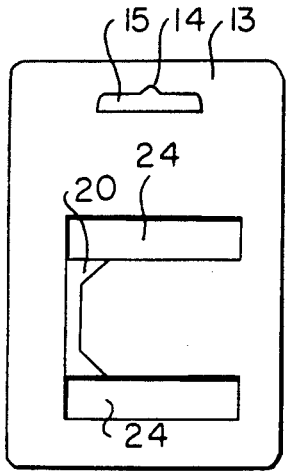
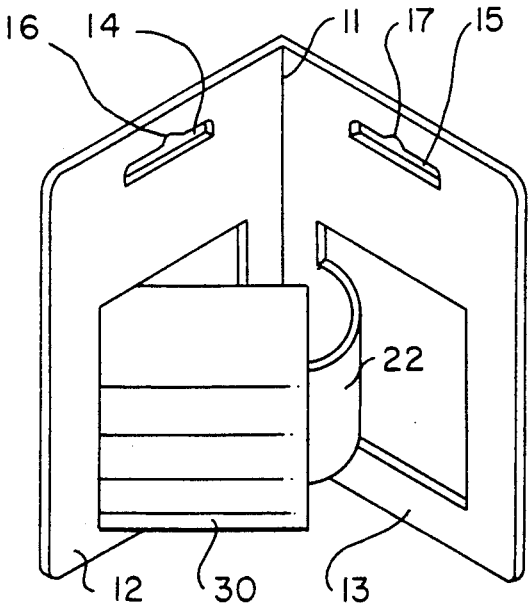
Fig. 2
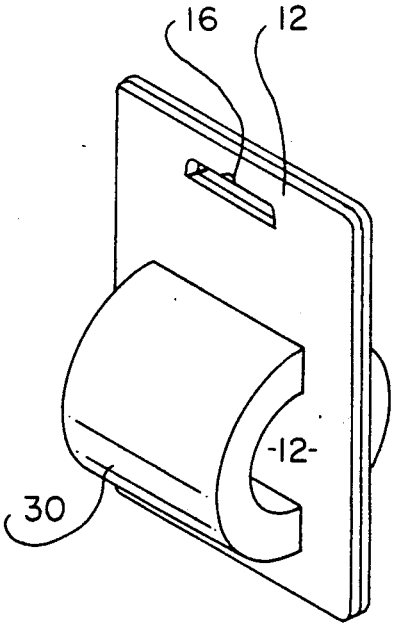
Fig. 4

DISPLAY HANGER PACKAGE FOR ROLL

BACKGROUND OF THE INVENTION

Rolls of tape are manufactured and sold. Such rolls are frequently merely packaged in cellophane but as a result have poor shelf appeal and may roll about if not properly confined.

Rolls of such tape may be sold in blister packages or may be encased in a suitably constructed carton.

However, most desirably, is to display such rolls in its own display hanger whereby it may be hung on a rack containing a plurality of such packages. The packages of such type also afford the imprinting thereon of suitable trademark indicia leading to enhancement of sales.

Accordingly, it is a primary object of the present invention to provide a package fabricated from a cardboard blank to hold a roll of wound up tape on a cardboard core. The package may be hung on a rack or the like for display.

SUMMARY OF THE INVENTION

A blank for a roll of tape is disclosed which is constructed from a flat carboard sheet having a fold line so that it may be folded over and glued. Each side of the blank on either side of the fold line has a U-shaped aperture each extending in the same direction. The two U-shaped apertures are positioned and dimensioned whereby they are in registry when folded. The roll of tape is mounted on the folded blank in a manner that the tongue like portions between the U-shaped apertures are inserted each from opposite sides of the blank as it is folded whereby the tongue portions are axially located with respect to the roll of tape.

BRIEF DESCRIPTION OF THE DRAWINGS

FIG. 1 is a plan view of the cut blank from which the hung card is fabricated.

FIG. 2 is a perspective view of the blank in a particular folded mode.

FIG. 3 is a view of the blank folded but without the roll of adhesive material on a core.

FIG. 4 is a perspective view of the device of the present invention having a roll of adhesive material thereon.

DETAILED DESCRIPTION OF THE INVENTION

Attention is directed to the Figures wherein, the device of the present invention consists of a blank 10 having a median fold line 11 to produce two substantially equal halves, that is, a first left half 12 and a right second half 13 as depicted from the drawings whereby the blank may be folded over as is shown in transition in FIG. 2 and in a complete fold as shown in FIG. 3.

The first half 12 has an elongate first aperture 14. The second half 13 has as elongate second aperture 15. In addition thereto the first aperture 14 has a first notch 16 and the second aperture 15 has a second notch 17. The said first and second apertures along with their respective notches are dimensioned and positioned in their respective portions of the blank whereby when a blank is folded for use as in FIG. 3 the said apertures and notches are in registry. The two notches 16 and 17 are detailed whereby the device of the present invention may be hung on a horizontally positioned rod or the like.

The first half 12 of the blank has a relatively large first U-shaped aperture 18 thereby defining a first tongue 20. The second half 13 of the blank has a relatively large second U-shaped aperture 21 thereby defining a second tongue 22. It is seen that the corners 23 of the respective tongues 20 and 22 have been cut to produce less of a sharp corner.

Also it will be noted that each of the U-shaped apertures are facing in the same direction when in the blank form of FIG 1.

It should also be noted that the dimension of the apices 25, measured from corner to corner 23 along a vertical axis, at the respective U-shaped apertures is small when compared to the respective leg portions 24, measured from corner 23 and the intersection with the leg portion 24, and along the leg portion 24 in a horizontal axis, of the respective U-shaped apertures.

As can be seen from FIG. 3, the leg portion 24 of the respective U-shaped apertures are in registry.

It will be seen from FIG. 3 that when the blank of the device is folded along fold line 11 the respective U-shaped apertures 18 and 21 are facing in opposite directions and the two tongues 20 and 22 bridge the blank to thereby leaving only leg portions 24 as two spaced elongated apertures.

The blank is designed whereby a roll of tape 30 on a cardboard core 31, for instance, is mounted during the folding process during which the tongues 20 and 22 are placed into the core as seen proceeding in FIG. 3 and in completion in FIG. 4.

It is pointed out that the two tongues 20 and 22 when taken together provide a complete strong axial core of the roll 30 of tape and each by itself extends for a distance about the axial width of the roll of tape. It should be noted, therefore, that the length of the respective tongues is proximate the axial length of the roll of tape 30.

The blank may be glued into a fixed permanent position so that it must be destroyed when the tape is to be removed therefrom. The roll of tape may be of eliptical configuration instead of circular whereby space may be saved as the entire package will thereby present less size in a third dimension.

The blank is constructed of cardboard or of other relatively thin material such as plastic whereby the respective tongues 20 and 22 may have a modicum of flexibility for ease of insertion into the hollow space defined by the core of the roll of tape material.

It is also contemplated that the blank not be glued thereby making it possible to retrieve the entire roll of tape from the package by reversing the folding of the blank to thereby free the roll of tape. The roll of tape may be then repackaged as desired.

It will be appreciated that the package can also be availed as a dispensing device whereby portions of the tape may be unwound and cut to desired lengths by suitable severing means.

It is also contemplated that the portion of the package having the roll of wound tape may be encased in a conventional blister assembly put thereabout in a known manner.

The package of the present invention is subject to pleasing display on a rack for a plurality of the packages, for instance, or on a hook on a wall. In each use a colorful back ground may be employed. The package itself may have suitable printed indicia as desired.

What is claimed is:

1. A one-piece blank for forming a display hanger for a roll of tape comprising a flat sheet, said sheet having a fold line to thereby divide the blank into essentially a first half and a second half, said first half having a first U-shaped aperture, thereby defining a first tongue, said second half having a second U-shaped aperture, thereby defining a second tongue, said U-shaped apertures and tongues each facing in the same direction when said first and second half are not folded and in opposite directions when said first half and second half are folded, each of said U-shaped apertures comprising an apex and two legs, the apices when measured top to bottom, of each of said U-shaped apertures being of smaller dimension than said respective legs when measured left to right of said U-shaped apertures, said U-shape apertures being in registry when said blank is folded along said fold line to thereby define in the folded blank the space apertures.

2. The one-piece blank of claim 1 wherein said first half has a first slit and said second half has a second slit each of said slits being positioned whereby they are in registry when said blank is folded along said fold line.

3. The one-piece blank of claim 2 wherein said first U-shaped aperture is defined by a first tongue portion having rounded corners and said second U-shaped aperture is defined by a second tongue portion having rounded corners.

4. A package for a roll having an axial bore therethrough comprising a folded blank, said folded blank made from a sheet, said sheet having a fold line to thereby divide the blank into essentially a first half and a second half, said first half having a first U-shaped aperture, thereby defining a first tongue, said second half having a second U-shaped aperture, thereby defining a second tongue, said U-shaped apertures and tongues each facing in the same direction, when said first and second half are not folded and in opposite directions when said first half and second half are folded, each of said U-shaped apertures comprising an apex and two legs, the apices when measured top to bottom, of each of said U-shaped apertures being of smaller dimension said respective legs when measured left to right of said U-shaped apertures, said U-shaped apertures being in registry when said blank is folded along said fold line to thereby define in the folded blank two spaced apertures, said roll passing through said legs of said U-shaped apertures when said blank is folded.

5. A package for a roll according to claim 4 wherein said first half has a first slit and said second half has a second slit, each of said slits being positioned whereby they are in registry when said blank is folded.

* * * * *